United States Patent [19]

Bennett-Robertson

[11] 3,994,395

[45] Nov. 30, 1976

[54] ARTICLE STORAGE DEVICE

[76] Inventor: Mavis Marion Bennett-Robertson, 46 Beaufort Gardens, London, S.W.3., England

[22] Filed: Dec. 3, 1974

[21] Appl. No.: 529,224

[30] Foreign Application Priority Data

| | | |
|---|---|---|
| Dec. 3, 1973 | United Kingdom | 56006/73 |
| Dec. 21, 1973 | United Kingdom | 59391/73 |
| June 17, 1974 | United Kingdom | 26744/74 |

[52] U.S. Cl. ..... 206/387

[51] Int. Cl.[2] ..... B65D 79/00; B65D 87/00

[58] Field of Search ..... 206/387, 309, 312, 313, 206/455, 456, 464, 465, 83, 84; 229/68 R

[56] References Cited

UNITED STATES PATENTS

| | | | |
|---|---|---|---|
| 1,132,972 | 3/1915 | Ralph | 206/312 |
| 2,521,792 | 9/1950 | Hollander | 206/.83 |
| 3,142,918 | 8/1964 | Offensend et al. | 206/456 X |
| 3,381,810 | 5/1968 | Lasher et al. | 206/387 X |
| 3,731,794 | 5/1973 | Garrod | 206/313 |
| 3,866,751 | 2/1975 | Holert | 206/387 |
| 3,907,116 | 9/1975 | Wolf et al. | 206/387 X |

FOREIGN PATENTS OR APPLICATIONS

| | | | |
|---|---|---|---|
| 292,106 | 1/1968 | Australia | 206/.84 |
| 381,088 | 10/1964 | Switzerland | 206/456 |

*Primary Examiner*—William Price
*Assistant Examiner*—Stephen Marcus
*Attorney, Agent, or Firm*—M. Ted Raptes

[57] ABSTRACT

A cover for an article such as a cassette or cartridge, the cover comprising two side pieces for covering at least a major part of opposing surfaces of the article. An intermediate piece is situated between the two side pieces and arranged to locate one end of the article within the side pieces.

8 Claims, 5 Drawing Figures

ARTICLE STORAGE DEVICE

FIELD OF THE INVENTION

This invention relates to covers which are particularly although not exclusively useful for cassettes and cartridges, but which may also be used for any other article which may be retained or supported by or within the cover.

STATEMENT OF THE INVENTION

The invention provides a cover for an article comprising two side pieces arranged to cover opposing major surfaces of an article, and an intermediate piece situated between the two side pieces and arranged to locate one end of the article within the side pieces.

The cover may be moulded or cast in one or more pieces of, for example, plastics material.

The two side pieces are preferably connected together along two opposite edges so as to provide a resilient opening for the article.

THe side pieces and the intermediate piece may be of cardboard so that the cover is substantially cheaper to manufacture than the plastics covers. Of, course, any suitable material, such as wood or metal may be used.

The side pieces and the intermediate piece may be glued together along the two opposite edges. Alternatively a flap may be provided on each of the said opposite edges of one of the side pieces. One surface of each flap may be glued to the other side piece and the other surface of each flap may be glued to the intermediate piece. Alternatively adhesive tape may be used to attach the side pieces and the intermediate piece together.

Of course, the intermediate piece may merely be placed between the side pieces and the pieces placed within an outer cover. The side pieces and intermediate piece are not therefore connected together but are retained together by the outer cover.

The intermediate piece may be substantially U-shaped and, where the cover is to be used for a cassette, the interior of the U may be formed to correspond with a standard size cassette so as to snugly engage three sides of the cassette and retain it within the cover.

A cassette is usually formed with lugs projecting from each side and these lugs may be used to assist in retaining the cassette within the cover. Thus when the cassette is put into the cover the lugs may pass between one of the side pieces and the intermediate piece or the lugs may be forced into the intermediate piece.

An article, such as a cartridge, may have recesses in its side walls instead of lugs and the facing edges of the limbs of the intermediate piece may be provided with lumps or thickenings to engage these recesses so as to engage in these recesses and securely retain the article within the cover.

The side pieces may each be formed with a cut-out in one end edge so that the cassette can be removed from the cover by the user gripping the cassette through the cut-outs.

The cardboard or other material used to make the intermediate piece might be substantially thicker than the material used to make the side pieces or it might be of the same thickness or cast or moulded in one or more pieces. In one embodiment the thickness of the intermediate piece is twice that of the side pieces. The thickness of the intermediate piece may be slightly less than the thickness of one end of a cassette so as to ensure that the cassette is securely gripped by the side pieces. If the thickness of the intermediate piece has the same or a greater thickness than the cassette, the limbs of the U-shaped intermediate piece may be spaced apart by a distance less than the width of the casseete so that the limbs grip the sides of the cassette or the lugs on the cassette and retain it within the cover.

The side pieces may have a greater surface area than the intermediate piece since this enables advertising material or other printed matter to be printed on the cover more easily. Alternatively only one of the side pieces is larger than the intermediate piece, the other side piece being the same size as the intermediate piece.

The cassette in its cover may be placed in an outer sleeve which may carry printed matter. If only one of the side pieces is larger than the intermediate piece the space within the outer sleeve between the larger side piece and the sleeve may be occupied by, for example, a catalogue or a musical score. Even when both side pieces are larger than the intermediate piece the space between the two may be occupied by a catalogue or musical score.

Alternatively the space may be occupied by a second intermediate piece and a second cassette so that a cassette is situated at each end of the cover. The cover may be used for retaining cassettes side by side; a single intermediate piece with two cut-outs for the cassettes being provided.

In a further embodiment the side pieces which are larger than the intermediate piece may be cut into shapes to make the casssette more attractive to the purchaser.

DESCRIPTION OF THE PREFERRED EMBODIMENT

Figure 1:
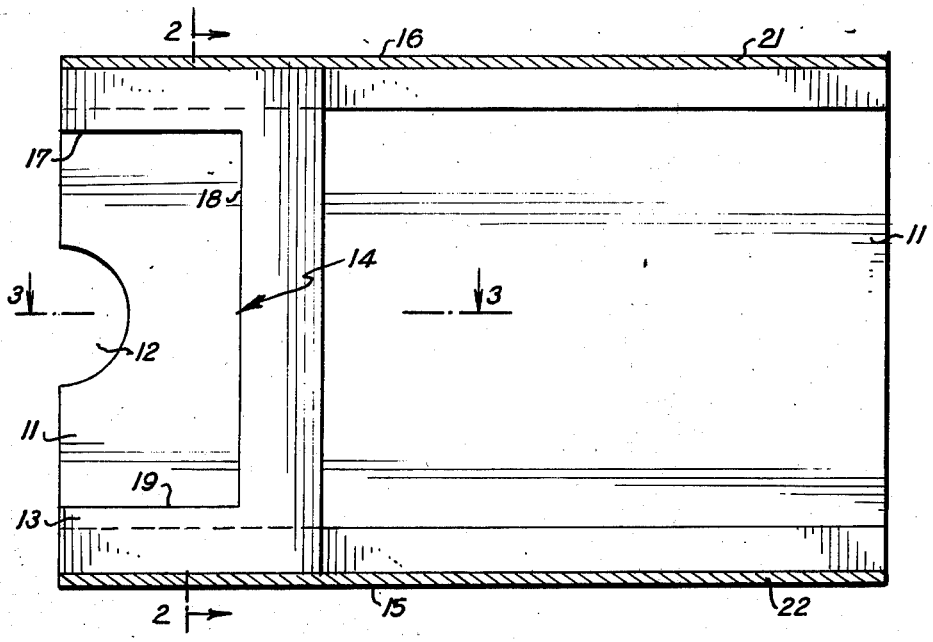
FIG. 1 is a plan view partially in section, along line 1—1 of FIG. 2 of a cassette cover with one of its side pieces removed.

The cassette cover includes two side pieces 11 of cardboard, only one of which is shown in FIG. 1. The side pieces are identical in size and each has a substantially semi-circular cut-out 12 at one end.

Figure 2:
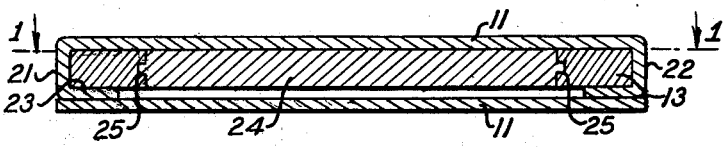
FIG. 2 is a section on the line 2—2 of FIG. 1 showing the cassette in position.
Figure 3:
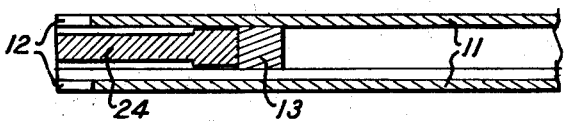
FIG. 3 is a section on the line 3—3 of FIG. 1 with a cassette in position.

An intermediate piece 13 is formed from a rectangular piece of cardboard which is about twice as thick as the cardboard forming the side pieces 11 as can be seen from FIGS. 2 and 3. A rectangular cut-out 14 is made in the intermediate piece, the size of the cut-out corresponding to the standard size cassette.

The three pieces 11 and 13 are placed together with the intermediate piece 13 between the two side pieces and with the cut-out 14 adjacent the cut-outs 12. The parallel side edges 15 and 16 of the three pieces are glued or otherwise sealed together so as to make a pocket for the cassette. As can be seen from FIGS. 2 and 3 the thickness of the cardboard forming the intermediate piece enables the cover to accommodate the cassette easily. a cassette 24 is stored in the cover by inserting it between the two side pieces 11 so that it fits with three of its sides snugly against the sides 17, 18 and 19 of the cut-out 14. The cassette 24 has lugs 25 on each side and, as can be seen in FIG. 2, these lugs gouge their way into the intermediate piece 13 and so assist in retaining the cassette in position. The intermediate piece 13 can also be provided with longitudinal recesses or grooves along sides 17 and 19 spaced from and disposed between side pieces 11. Lugs 25 of the cassette will be engaged in the recesses when the cassette is inserted into the rectangular cutout 14, and the cassette will be snugly engaged therein when fully inserted. Alternatively the lugs 25 may pass between one of the side pieces 11 and the intermediate piece 13. The intermediate piece thus locates the cassette within the two side pieces.

When the cassette 24 is to be removed from the cover the cut-outs 12 enable the cassette to be gripped by the user and removed from the cover.

In order to seal with edges 15 and 16 of the pieces together one of the side pieces 11 may be formed with a flap 21 extending along each of its edges 15 and 16. This construction can be seen in FIG. 2 which shows the top side piece 11 with a flap 21 on each of its edges 15 and 16. One side 22 of each of these flaps may be glued or otherwise adhered to the other side piece 11 while the other side 23 of each flap is glued or otherwise adhered to the intermediate piece 13.

Of course, alternative methods of connecting the sides 15 and 16 together are also possible. Thus instead of flaps attached to one of the side pieces separate flaps may be provided. These may take the form of strips which can be glued on one side to the intermediate piece and on the other side to each of the side pieces.

It will be seen from FIG. 1 that the area of the side pieces is considerably greater than that of the intermediate piece 13. This enables the cover to carry a considerable amount of advertising material or other printed matter. Of course, the side pieces need not be larger than the intermediate piece.

Figure 4:
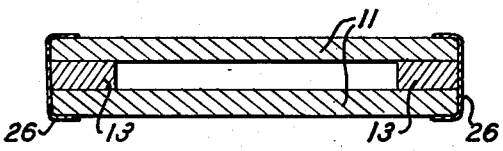
FIG. 4 is a view similar to FIG. 2 of an alternative embodiment.

In the modification shown in FIG. 4 the cardboard forming the side pieces 11 and the intermediate piece 13 has the same thickness. Adhesive tape 26 is used to join the pieces together.

Figure 5:
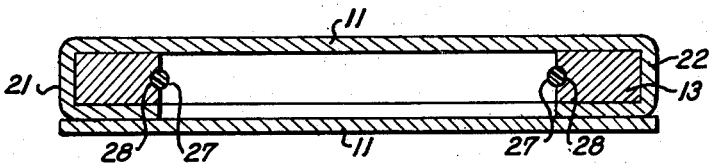
FIG. 5 is a section through a modified cover.

FIG. 5 shows a section through a further embodiment of a slightly enlarged scale. Parts similar to those described with reference to the previous embodiments have been given like reference numerals. Recesses 28 are provided on the facing edges of the intermediate piece 13. Glued or otherwise attached to these recesses are round balls 27 of a resilient material such as plastics. This type of cover can be used for articles such as cassettes which have outwardly projecting lugs as described with reference to FIGS. 1 to 3 or for articles which have no such projecting lugs. The article is pushed into the cover and in so doing the side walls or the lugs depress the plastics material so that the article is frictionally retained within the cover. On removing the article the balls 27 resile.

It will be appreciated that the embodiment shown in FIG. 5 could also be used for articles, such as cartridges, which are provided with recesses grooves in their side walls. On pushing the article into the cover the resilient balls would engage the recesses and so securely retain the article within the cover.

A number of modifications to the embodiments described are of course possible. The covers described are convenient for storage purposes and when used to store cassettes the cassettes in their covers can conveniently be stored in racks or cases designed for storing records so that it is not necessary for the user to purchase additional equipment.

The cover may be circular in shape so as to hold microfilm spools or other circular objects. The cover may be used for an article such as a telephone receiver which may rest inside it.

While the object has been described as a cover, it will be appreciated that it need not completely cover the article and it could be used to cover only a part of an article.

What I claim is:

1. In combination, an article and an article storage device; said article comprising two opposing major surfaces, two opposing end surfaces, and two substantially parallel opposing side surfaces each of which have longitudinal lugs therealong; said storage device comprising opposed facing members extending substantially parallel to each other, a substantially U-shaped intermediate member disposed between said opposed members of said storage device, the limbs of said U-shaped member defining two opposed facing side surfaces, and the web of said U-shaped member defining an abutment surface; whereby said opposed facing surfaces and said abutment surface of said U-shaped member and said opposed members define a recess adapted to receive and snugly retain said article, and whereby said opposed members of said storage device overlay at least a major portion of each of said major surfaces of said article; said opposed facing surfaces of said U-shaped member comprising engagement means adapted to frictionally engage said lugs of said side surfaces of said article when said article is stored in said storage device; said engagement means formed by said lugs upon insertion of said article into said storage device.

2. The combination of claim 1 wherein each of said opposed members of said storage device has two opposite edges and wherein said opposed members are connected together along said opposite edges so as to provide a resilient opening for the insertion of said article.

3. The combination of claim 2 wherein said opposed members and said U-shaped intermediate member of said storage device are connected together along said two opposite edges.

4. In combination, an article and an article storage device; said article comprising two opposing major surfaces, two opposing end surfaces, and two substantially parallel opposing side surfaces each of which have longitudinal lugs therealong; said storage device comprising opposed facing members extending substantially parallel to each other, a substantially U-shaped intermediate member disposed between said opposed members of said storage device, the limbs of said U-shaped member defining two opposed facing side surfaces, and the web of said U-shaped member defining an abutment surface; whereby said opposed facing surfaces and said abutment surface of said U-shaped member and said opposed members define a recess adapted to receive and snugly retain said article, and whereby said opposed members of said storage device overlay at least a major portion of each of said major surfaces of said article; said opposed facing surfaces of said U-shaped member comprising engagement means adapted to frictionally engage said lugs of said side surfaces of said article when said article is stored in said storage device; said engagement means formed by said lugs upon insertion of said article into said storage device; at least one of said opposed members provided with a flap which extends around a limb of said U-shaped intermediate member and is secured thereto and the inner surface of the other opposed member.

5. The combination of claim 4 wherein said engagement means comprise longitudinally extending grooves adapted to frictionally engage said lugs of said side surfaces of said article when said article is stored in said storage device.

6. In combination, an article and an article storage device; said article comprising two opposing major surfaces, two opposing end surfaces, and two substantially parallel opposing side surfaces; said storage device comprising opposed members extending substantially parallel to each other, a substantially U-shaped intermediate member disposed between said opposed members of said storage device, the limbs of said U-shaped member defining two opposed facing side surfaces, and the web of said U-shaped member defining an abutment surface; whereby said opposed facing surfaces and said abutment surface of said U-shaped member and said opposed members define a recess adapted to receive and snugly retain said article, and whereby said opposed members of said storage device overlay at least a major portion of each of said major surfaces of said article; said opposed facing surfaces of said U-shaped member comprising engagement means adapted to frictionally engage said lugs of said side surfaces of said article when said article is stored in said storage device; said engagement means comprising resilient members disposed longitudinally along said opposed facing side surfaces of said U-shaped member adapted to frictionally engage said surfaces of said article when said article is stored in said storage device.

7. The combination of claim 6 wherein said article comprises longitudinal grooves along said opposing side surfaces adapted to engage said longitudinal resilient means.

8. In combination, an article and an article storage device; said article comprising two opposing major surfaces, two opposing end surfaces, and two substantially parallel opposing side surfaces each of which have longitudinal extending ribs therealong; said storage device comprising a recess having substantially the same shape as the article for snugly receiving said article, said recess comprising two opposed facing members extending substantially parallel to each other, a substantially U-shaped intermediate member disposed between said opposed facing members, the limbs of said U-shaped member defining two opposed facing side surfaces, and the web of said U-shaped member defining an abutment surface, said opposed facing members overlaying at least a major portion of each of said major surfaces of said article, said opposed facing surfaces of said U-shaped member comprising longitudinally extending grooves spaced from and between said opposed facing members adapted to frictionally engage said ribs of said side surfaces of said article when said article is stored in said storage device, to thereby retain said article within said recess, said opposed facing members comprising cutouts disposed between said limbs of said U-shaped member, whereby said article can be grasped and removed from said recess.

* * * * *